US005253438A

United States Patent [19]

Norizuki et al.

[11] Patent Number: 5,253,438

[45] Date of Patent: Oct. 19, 1993

[54] DISPLAY APPARATUS AND DISPLAY METHOD USING THE SAME

[76] Inventors: Katsuji Norizuki, 2-7-17 Heiwa; Hideo Kudoh, 2-12-23 Kusanagi, both of Shizuoka, Japan

[21] Appl. No.: 709,281

[22] Filed: Jun. 3, 1991

[30] Foreign Application Priority Data

Jun. 22, 1990 [JP] Japan ..... 2-165078
May 16, 1991 [JP] Japan ..... 3-111437

[51] Int. Cl.[5] ..... G09F 11/30
[52] U.S. Cl. ..... 40/511; 40/509
[58] Field of Search ..... 40/509, 511

[56] References Cited

U.S. PATENT DOCUMENTS

| | | | |
|---|---|---|---|
| 97,034 | 11/1869 | Brownlee | 40/509 |
| 129,764 | 7/1872 | Stone | 40/511 |
| 187,726 | 2/1877 | Peden | 40/511 |
| 594,506 | 11/1897 | Wheeler | 40/511 |
| 1,224,512 | 5/1917 | Teetor | 40/511 |
| 1,235,168 | 7/1917 | Stömer | 40/511 |
| 1,707,158 | 3/1925 | Brown | 40/511 |

FOREIGN PATENT DOCUMENTS

| | | | |
|---|---|---|---|
| 280587 | 12/1930 | Italy | 40/511 |
| 276192 | 11/1989 | Japan | 40/511 |
| 468947 | 7/1937 | United Kingdom | 40/511 |

*Primary Examiner*—Kenneth J. Dorner
*Assistant Examiner*—C. Hope Davis
*Attorney, Agent, or Firm*—Kanesaka and Takeuchi

[57] ABSTRACT

A display apparatus and a display method using this apparatus in which a plurality of circulating members are accommodated in two accommodation chambers formed in a frame. The circulating members are circulated by being moved vertically or laterally by first and second feed devices and first and second transport devices so that the display is successively changed, thereby enabling various information items to be displayed easily and conveniently.

6 Claims, 13 Drawing Sheets

DISPLAY APPARATUS AND DISPLAY METHOD USING THE SAME

BACKGROUND OF THE INVENTION

This invention relates to an apparatus for effecting desired display by accommodating a multiplicity of circulating members in a frame and rotatively moving the circulating members one by one so that each circulating member faces a display window to change the display.

Conventional rotary advertising apparatuses are known which move advertisement surfaces to enable viewers to feel some dynamic advertising effect to attract their attention. (Refer to Japanese Patent Publication No.53-37200).

This type of apparatus is constructed in such a manner that rotatable two chains are disposed along two inner surfaces of lateral frame plates standing upright on a base, and a multiplicity of advertisement plates set on a mount side plates vertically standing on the base between the chain belts and being spanned between the mount plates can be moved upward and downward by hooks rotatably and axially attached to the chain belts, as the chain belt are rotated.

This type of rotary advertising apparatus entails various problems as described below.

In this advertising apparatus, the region in which advertisement member has an advertisement surface on one side is limited to a bottom section of a box-like body. The number of advertisement members which can be accommodated is therefore small in comparison with the size of the box-like body. This apparatus cannot sufficiently display by using many advertisement members.

The advertisement members are moved and changed while being hung from and retained by the hooks provided on the chain belts, and this movement can be effected smoothly so long as the advertisement members are moved vertically while hanging. However, if this advertising apparatus is positioned laterally so that the advertisement members are moved in a horizontal direction, the advertisement members are disengaged from the hooks and cannot be moved.

SUMMARY OF THE INVENTION

In view of these problems, an object of the present invention to provide a display apparatus and a display method using this apparatus in which a plurality of circulating members are accommodated in two accommodation chambers formed in a frame, and in which the circulating members are circulated so that the display is successively changed to enable various information items to be displayed easily and conveniently.

A display apparatus and a display method in accordance with the present invention are based on rotatively moving circulating members in a frame so as to renew the display portion continuously and automatically. The accommodation space in which circulating members are accommodated is partitioned into two chambers. Circulating members can be fully set in these two chambers. The number of circulating members having information to be displayed can thereby be maximized, thereby increasing the display capacity.

The orientation of the apparatus is not limited; the apparatus can be placed in either vertical or lateral position and can be freely designed and manufactured according to needs. The ornamental effect can also be improved by selecting a shape and design suitable for the place where the apparatus is installed.

The direction of circulation of the circulating members can be reversed. This direction is set according to conditions for use to provide various design effects when the apparatus is placed.

DESCRIPTION OF THE PREFERRED EMBODIMENTS

Figure 1:
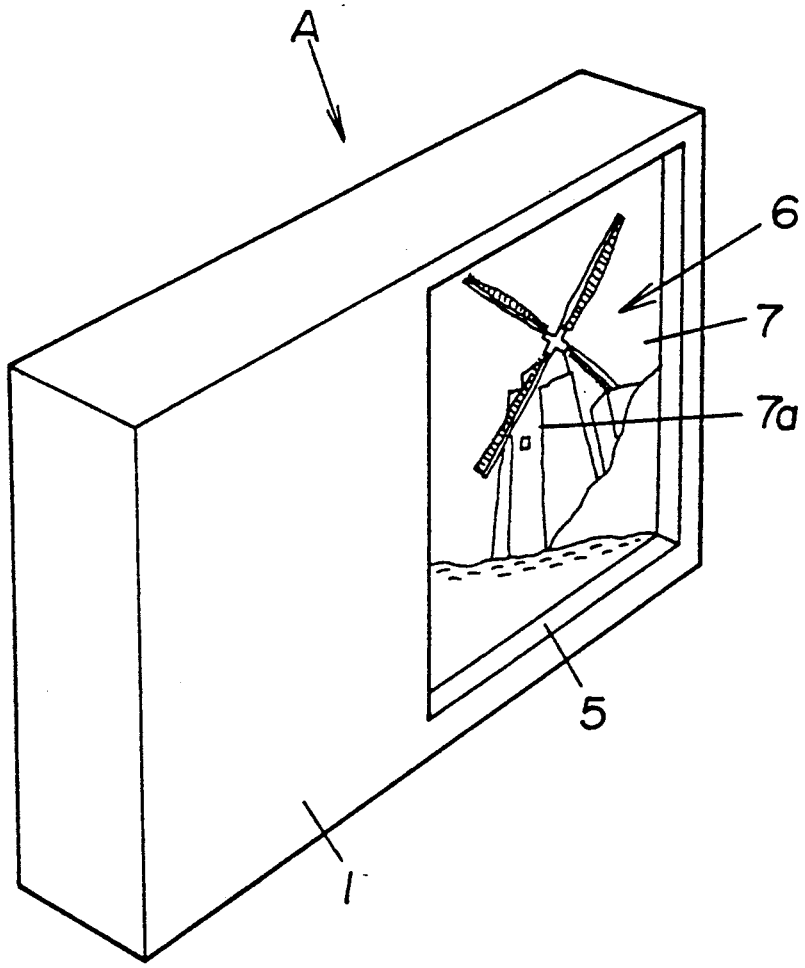
FIG. 1 is a perspective view of a display apparatus in accordance with a first embodiment of the present invention.

Embodiments of the present invention will be described below with reference to the accompanying drawings.

FIGS. 1 to 4 show a display apparatus A in accordance with a first embodiment of the present invention and in which circulating members described later are circulated between left and right positions.

In this embodiment, a frame 1 formed into a box-like shape of a predetermined size has an internal space partitioned at its center into right and left sections, i.e., a first accommodation chamber 3 and a second accommodation chamber 4 by a partition plate 2. A display window 5 generally equal in size and shape to each of the circulating members described later is formed in one side wall of the first accommodation chamber 3.

Paths 2*a* through each of which one of the circulating members can pass are formed on the front and rear sides of the first and second accommodation chambers 3 and 4 partitioned by the partition plate 2.

Figure 12:
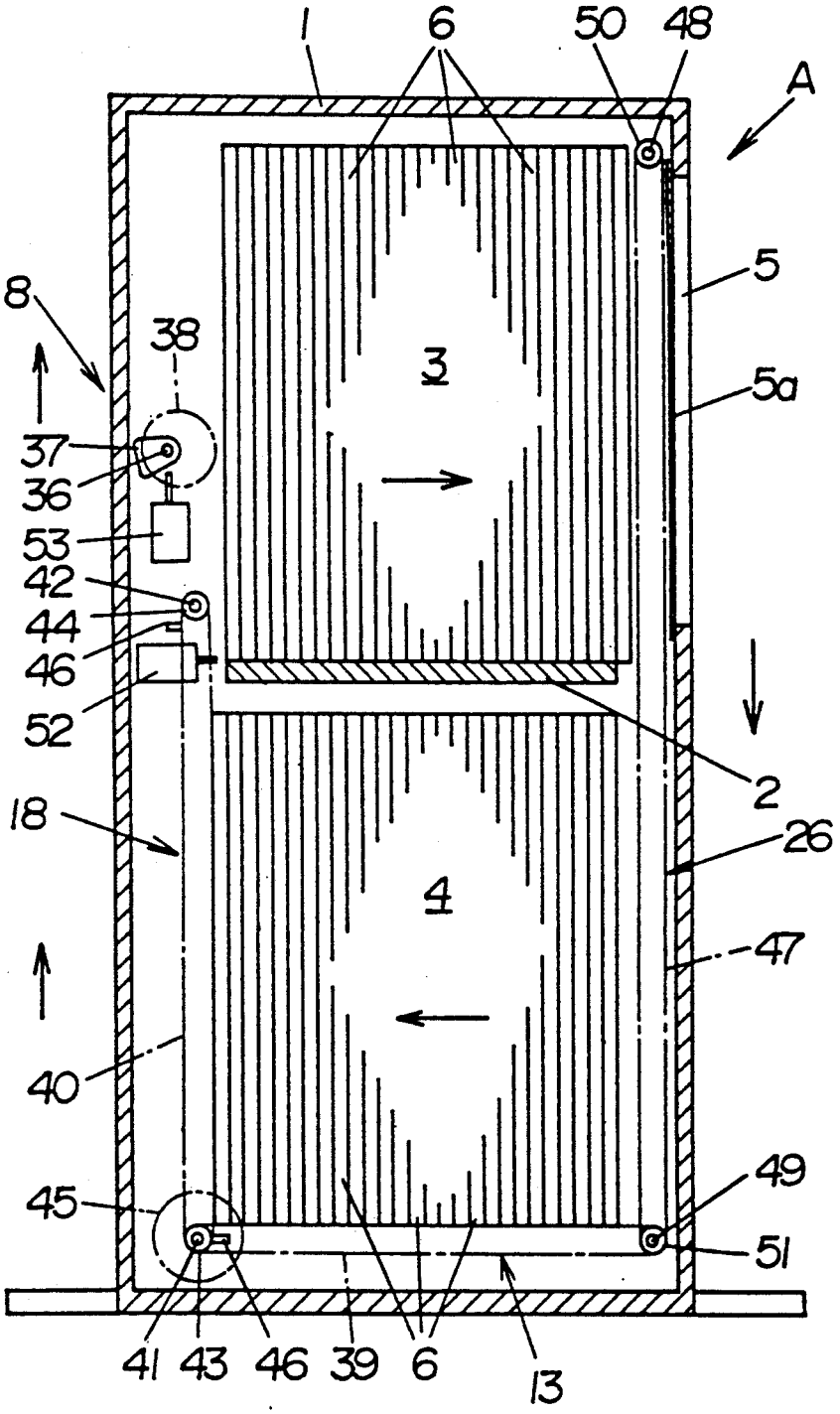
FIG. 12 is a transverse sectional side view of the display apparatus shown in FIG. 11.

As shown in FIG. 12, a transparent cover plate 5a formed of acrylic resin or the like may be provided on the front side of the display window 5 to prevent dust, foreign matters, rain water and the like from entering when the apparatus is placed outdoors. If illuminators (not shown) are attached on the periphery of the display window 5, display is possible in a dark place.

Figure 6:
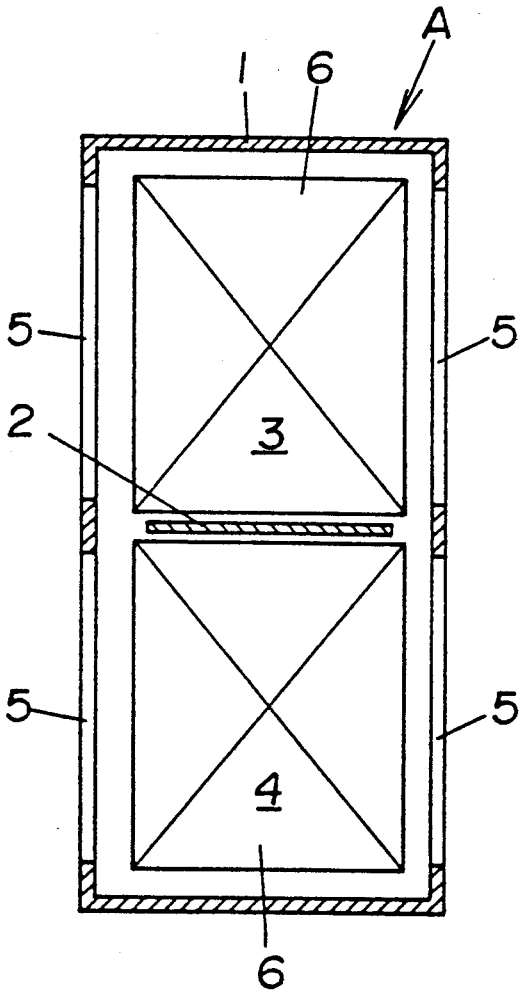
FIG. 6 is a transverse sectional plan view of still another example of the arrangement of the display window shown in FIG. 1.
Figure 5:
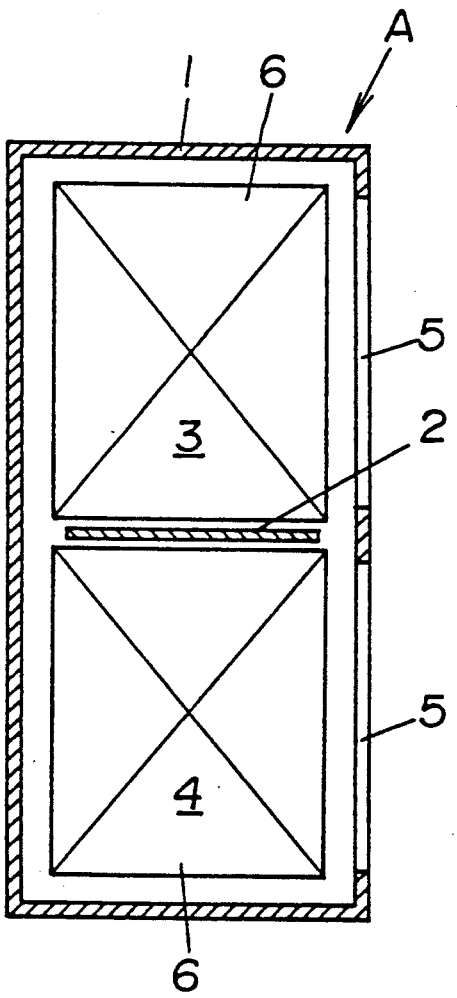
FIG. 5 is a transverse sectional plan view of another example of the arrangement of the display window shown in FIG. 1.

Other display windows 5 may be provided, for example, on one side of each of the first and second accommodation chambers 3 and 4, as shown in FIG. 5, or on the obverse and reverse sides of the frame 1, as shown in FIG. 6.

Figure 7:
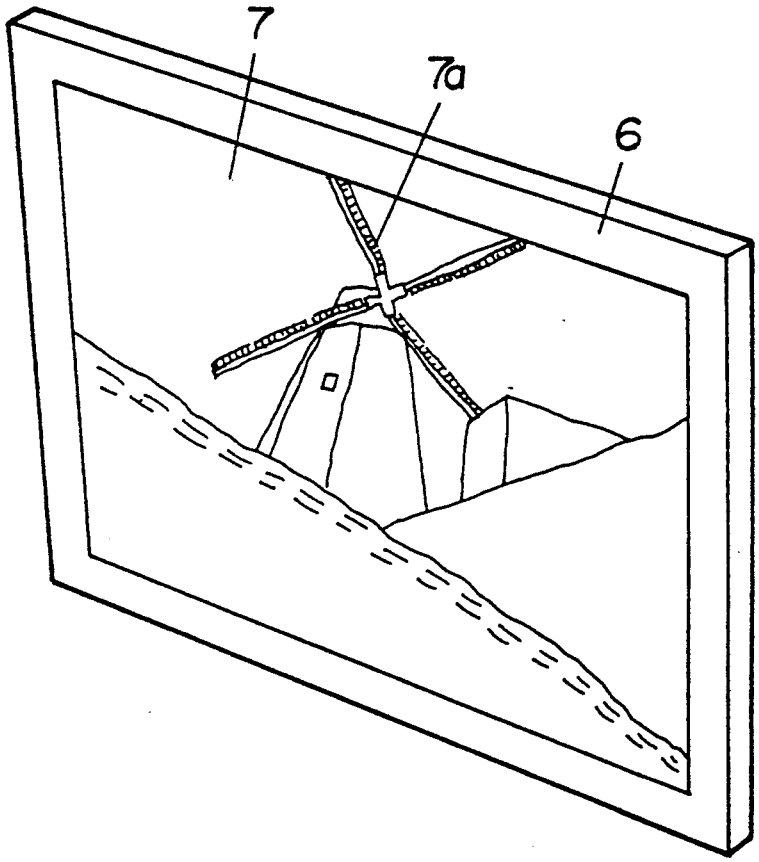
FIG. 7 is a perspective view of the circulating member of the apparatus shown in FIG. 1.

A reference numeral 6 denotes a multiplicity of circulating members stacked in an upright position in the first and second accommodation chambers 3 and 4. As shown in FIG. 7, each circulating member is formed as a square or rectangular plate or a disk (preferably, elliptical plate having a desired directionality) having a predetermined thickness, and a display member 7 having a display portion 7a is attached to one surface of each circulating member by an adhesion or fitting means.

One group of display members 7 is provided in the first accommodation chamber 3 so that the surfaces of their display portions face the display window 5 and so that the orientation of display coincides with the vertical direction of the apparatus. The number of display members 7 accommodated in this manner, which varies according to the thickness of the circulating members 6, is determined so that the overall thickness of the stacked circulating members 6 with the display members 7 is within the size of the partition plate 2 in the direction of the depth of the accommodation chambers or, preferably, equal to the size of the partition plate 2 when the circulating members 6 are accommodated. In the second accommodation chamber 4, the display members 7 also face in the same direction. Equal numbers of circulating members 6 or the display members 7 are accommodated in the first and second accommodation chambers 3 and 4. Lower side surfaces of the circulating members 6 are slidably supported on a support plate 1a of the frame 1.

Figure 9:
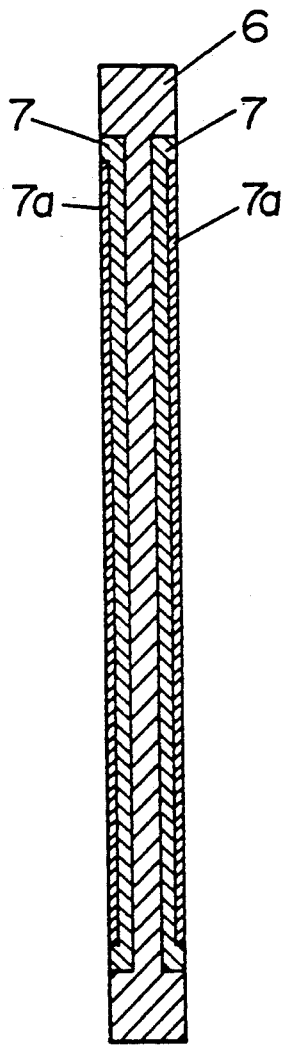
FIG. 9 is a longitudinal sectional plan view of another example of the circulating member shown in FIG. 7.
Figure 8:
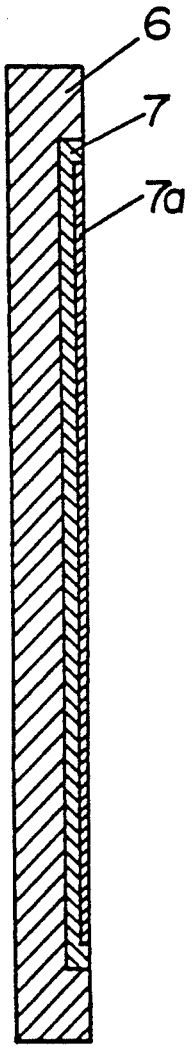
FIG. 8 is a longitudinal sectional plan view of the circulating member shown in FIG. 7.

The display member 7 on each circulating member 6 may be a kind of clear paper folder in which a display sheet is inserted and retained, and may be provided on each side of the circulating member 6 with the display portion 7a, as shown in FIG. 9.

As objects to be displayed on the display portions 7a or display contents, calendars, notifications or advertisements, such as real property advertisements or guides, photographs, characters are suitable, and other objects can also be used.

Figure 10:
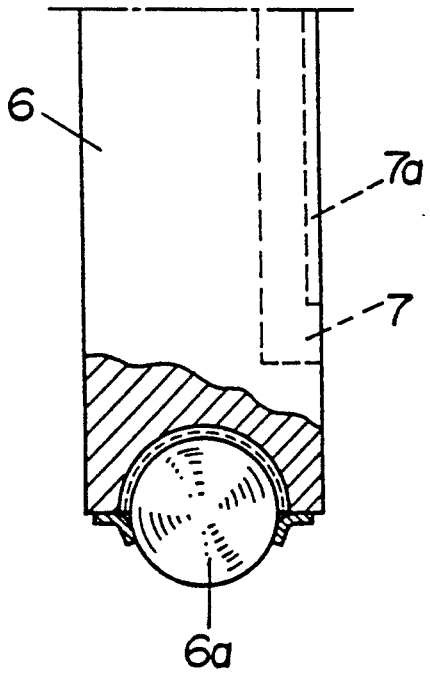
FIG. 10 is a longitudinal sectional side view of still another example of the circulating member shown in FIG. 7.

If the size of the display apparatus A is increased, the size of the circulating members 6 accommodated therein is also increased. In such a case, to make the lateral movement of the circulating members 6, freely rotatable wheels may be provided under the lower side of each circulating member 6, or balls 6a capable of rolling in every direction may be attached as shown in FIG. 10.

Figure 2:
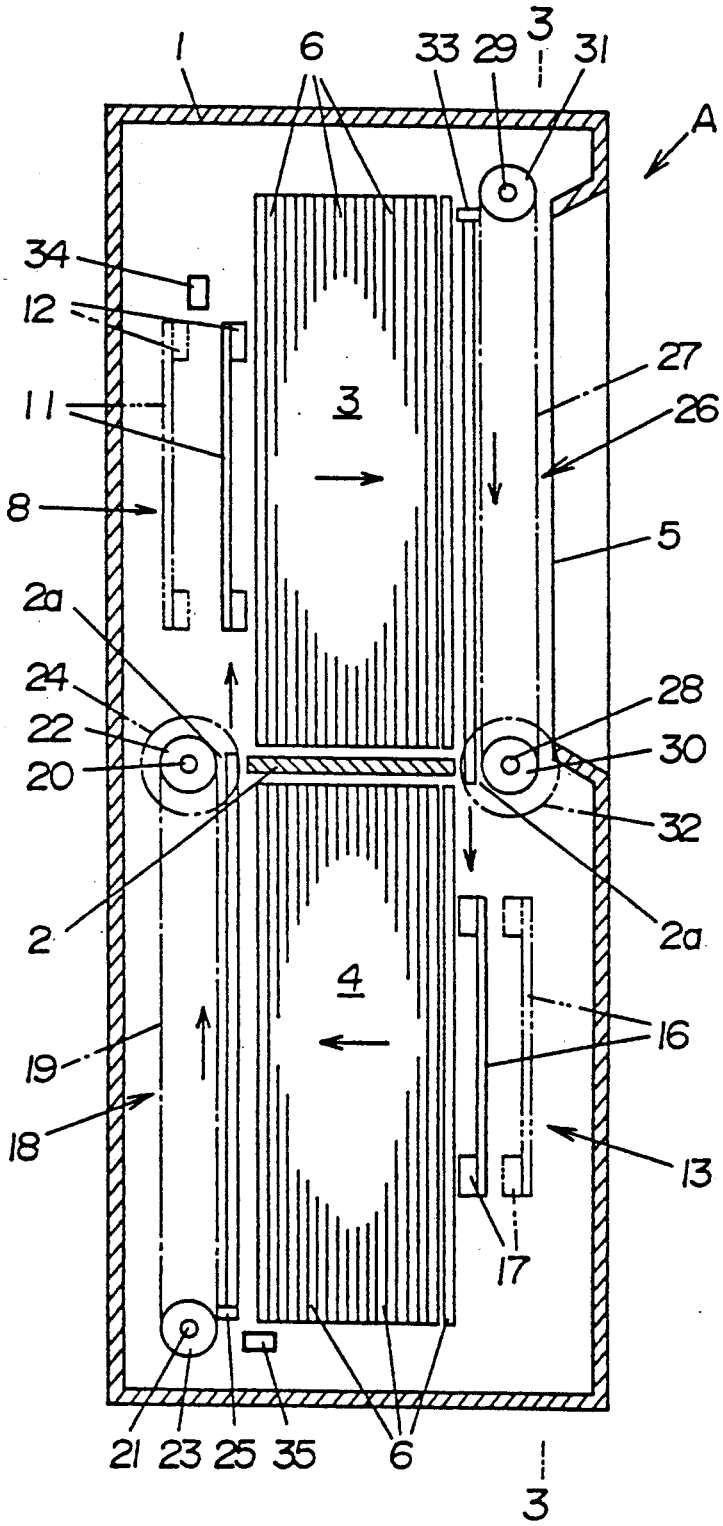
FIG. 2 is a transverse sectional plan view of the display apparatus shown in FIG. 1.
Figure 3:
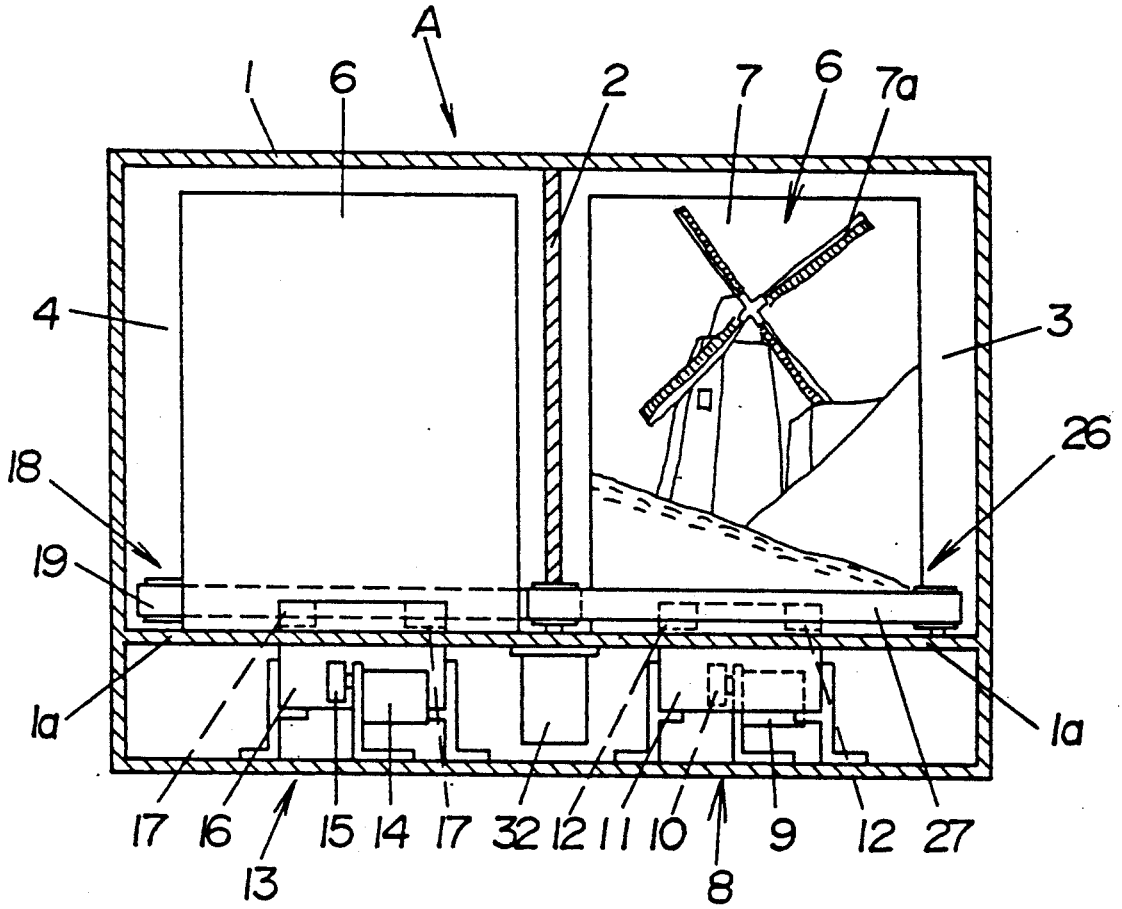
FIG. 3 is a sectional view taken along the line 3—3 of FIG. 2.

A first feed means 8 serves to intermittently feed one group of circulating members 6 toward the display window 5 in the first accommodation chamber 3. The feed means 8 faces the foremost one of these circulating members 6 on the non-display side. As shown in FIGS. 2 and 3, pressing pieces 12 are attached to a press-feed member 11 capable of advancing and retreating by a cam 10 driven by a motor 9, and are engaged with the lower side of the circulating member 6, thereby enabling the group of circulating members 6 to be fed by a pitch corresponding to one circulating member 6 when the motor 9 is driven. Namely, since the press-feed member 11 moves back and fourth by rotation of the cam 10, the circulating members 6 are moved to the display window 5.

A second feed means 13 serves to intermittently feed the other group of circulating members 6 in the second accommodation chamber 4 in the direction opposite to the direction of feeding of the group of circulating members 6 in the first accommodation chamber 3. The feed means 13 faces the foremost display side of the circulating members 6. The second feed means 13 has the same construction of the first feed means 8 as shown in FIG. 3. That is, pressing pieces 17 are attached to a press-feed member 16 capable of advancing and retreating by a cam 15 driven by a motor 14, and are engaged with the lower side of the circulating member 6, thereby enabling the group of circulating members 6 to be fed by a pitch corresponding to one circulating member 6 when the motor 14 is driven. Namely, the press-feed member 10 is moved back and fourth by the cam 15 to thereby advance the circulating members 6.

A first transport means 18 serves to laterally move one circulating member 6 from the second accommodation chamber 4 to the adjacent first accommodation chamber 3. Transport means ordinarily used, such as a conveyor type mechanism including a belt or chain stretched in an endless manner, a rack and pinion type mechanism, or a mechanism including a screw shaft rotated by a motor, may be utilized as first transport means 18.

In the case of a conveyor type mechanism for this transport means, as shown in FIG. 2, an endless belt 19 a major portion of which extends parallel to the circulating member 6 adjacent to it and contacts a lower portion of the circulating member 6 on the non-display side is stretched around pulleys 22 and 23 attached to driving and driven shafts 20 and 21, and a motor 24 having a speed reduction mechanism is connected to the driving shaft 20 to rotate the belt in one direction or in the normal/reverse direction.

A engagement piece 25 is provided in one or two places on the endless belt 19 so as to project outward. As the endless belt 19 is moved, the engagement piece 25 is brought into engagement with a lower side portion of the circulating member 6 to move the same to the adjacent first accommodating chamber 3, thus enabling the circulating members 6 to be intermittently moved laterally.

The endless belt 19 may be moved in one direction corresponding to the direction of transport of the circulating member 6 so that the engagement piece 25 is brought to a feed start base position, or may be driven by reversing the motor 24 after the completion of the lateral travel of one circulating member 6 so that the engagement piece 25 is returned to the start base position.

An attraction means using a magnet or the like (not shown) may be provided instead of the engagement piece 25 in such a manner that a belt-like magnetic member is attached to a lower portion of each circulating member 6 on the non-display side, a magnet capable of facing this magnetic member is disposed in one or two places on the endless belt 19, and the circulating member 6 is transported by being held by the attraction force of this magnet. Further, an attraction means using an air pad can also be used by attaching to the endless belt 19 to transport the circulating member 6 in the same manner. The endless belt can be adopted alternatively to a rack or a screw frame attached to a screw shaft of the above-mentioned means.

A second transport means 26 serves to laterally move one circulating member 6 from the first accommodation chamber 3 to the adjacent second accommodation chamber 4. Transport means ordinarily used, such as a conveyor type mechanism including a belt or chain stretched in an endless manner, a rack and pinion type mechanism, or a mechanism including a screw shaft rotated by a motor, may be utilized as second transport means 26, as in the case of the first transport means.

The second transport means 26 may have the same construction as the first transport means, and only an example of a conveyor type mechanism for this transport means will be described below.

In this example, as shown in FIG. 2, an endless belt 27 a major portion of which extends parallel to the circulating member 6 adjacent to it and contacts a lower portion of the circulating member 6 on the display side 7*a* is stretched around pulleys 30 and 31 attached to driving and driven shafts 28 and 29, and a motor 32 having a speed reduction mechanism is connected to the driving shaft 28 to rotate the belt in one direction or in the normal/reverse direction. An engagement piece 33 is provided in one or two places on the endless belt 27 so as to project outward. As the endless belt 27 is moved, the engagement piece 33 is brought into engagement with a lower side portion of the circulating member 6 to move the same to the adjacent second accommodating chamber 4, thus enabling the circulating members 6 to be intermittently moved laterally.

The endless belt 27 may be moved in one direction corresponding to the direction of transport of the circulating member 6 so that the engagement piece 33 is brought to a feed start base position, or may be driven by reversing the motor 32 after the completion of the lateral travel of one circulating member 6 so that the engagement piece 33 is returned to the start base position.

An attraction means such as a magnet or an air pad may be attached instead of the engagement piece 33. In such a case, the attraction mechanism may also be constructed in the same manner as the first transport means.

Preferably, the first and second feed means 8 and 13 and the first and second transport means 18 and 26 are operated in a synchronizing manner.

Detection means 34 and 35 serve to control the rotation of each of the pairs of motors 9 and 14, and 24 and 32. Each of the detection means 34 and 35 comprises a limit switch, a proximity switch, a photoelectric tube or the like. The detection means 34 is provided in the vicinity of the first feed means 8 and serves to supply power to the motors 24 and 32 for driving the first and second transport means 18 and 26 through an associated controller (not shown) to operate these motors, when the controller receives a detection signal generated by the movement of the press-feed member 11 driven by the motor 9 of the first feed means 8 already started. The circulating members 6 are thereby laterally moved by the predetermined distance to be transported into the first and second accommodation chambers 3 and 4. The motors 24 and 32 are stopped when the transportation of the circulating members 6 is completed.

The detection means 35 is provided in the vicinity of the first transport means 18 and serves to supply power to the motors 9 and 14 for driving the first and second feed means 8 and 13 through an associated controller (not shown) to operate these motors, when the controller receives a detection signal generated by the movement of the engagement piece 25 driven by the motor 24 of the first transport means 18 already started. The groups of circulating members 6 are thereby longitudinally moved by the pitch corresponding to one circulating member 6. The motors 9 and 14 are stopped when the feeding of the circulating members 6 is completed.

Figure 4:
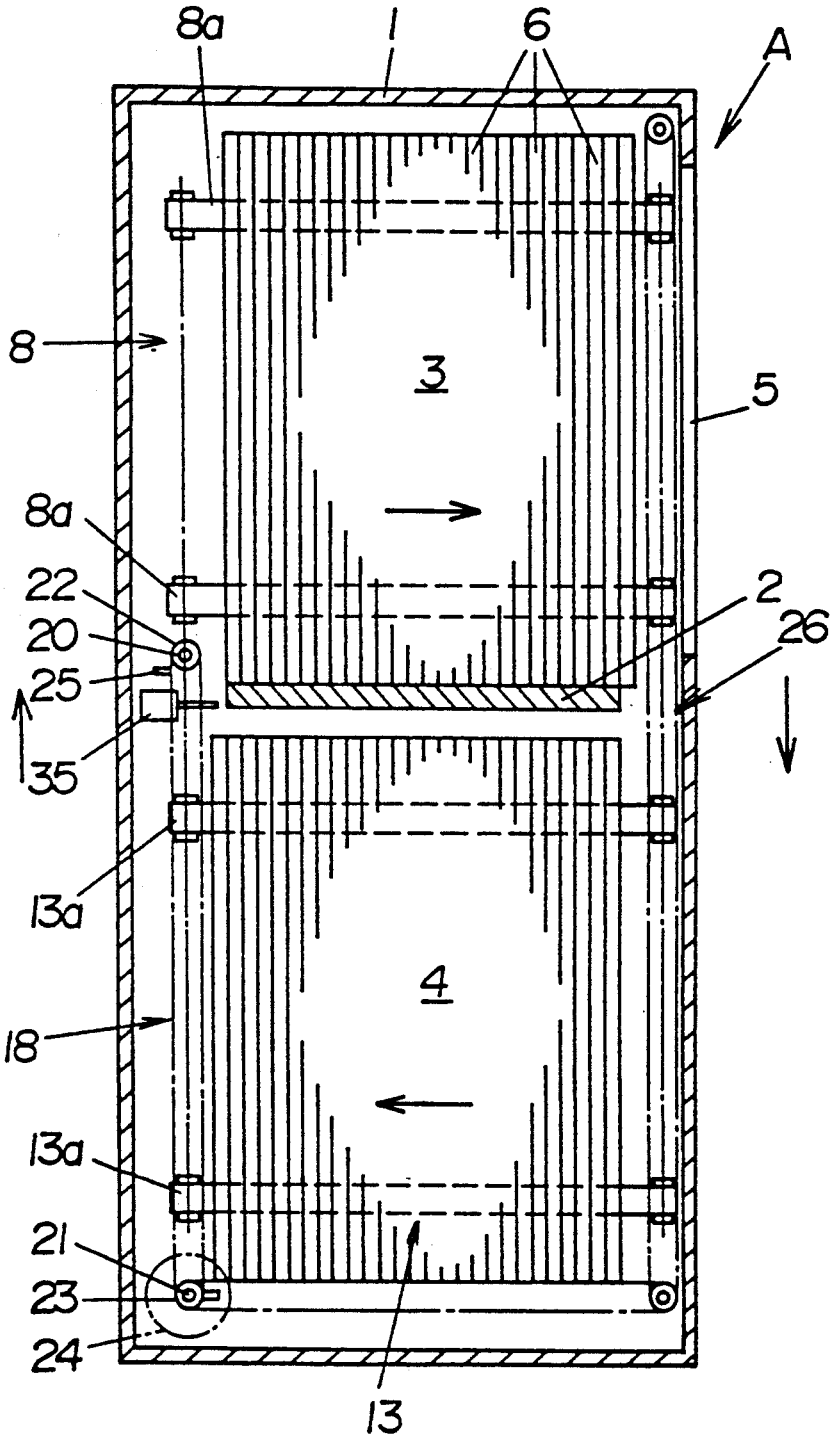
FIG. 4 is a transverse sectional plan view of another example of each of the first and second feed means shown in FIG. 1.

The first and second feed means 8 and 13 may be constructed by disposing conveyors 8*a* and 13*a* using endless belts at the bottoms of the first and second accommodation chambers 3 and 4, as shown in FIG. 4.

Needless to say, the apparatus can be arranged to effect the circulation motion in either clockwise or counter clockwise direction.

Figure 11:
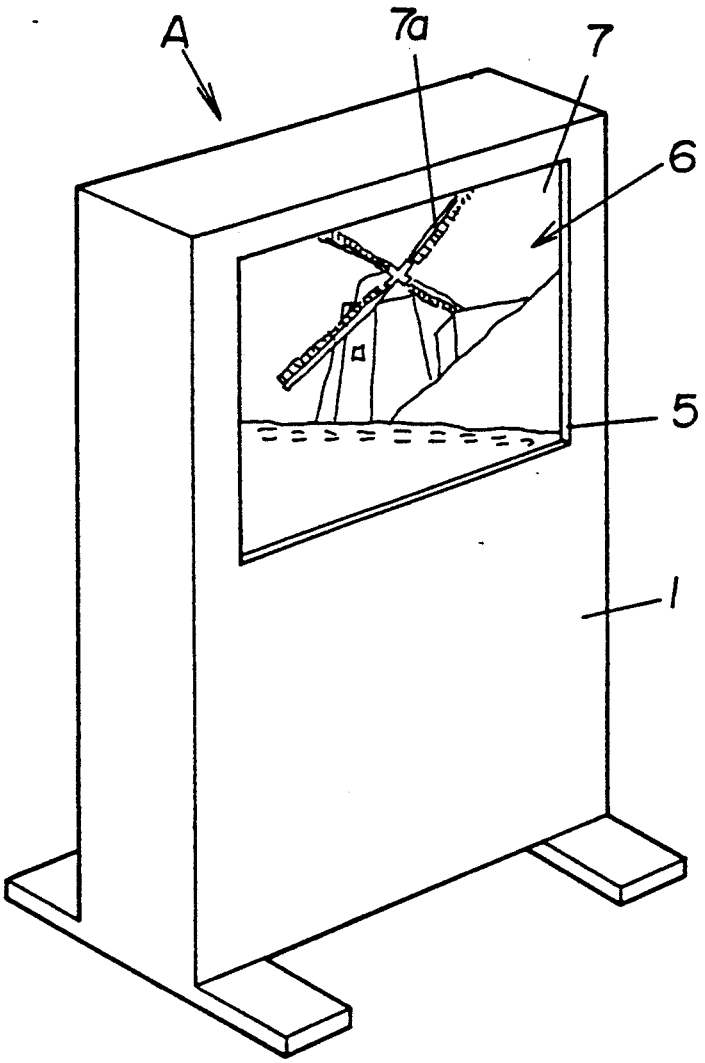
FIG. 11 is a perspective view of a display apparatus in accordance with a second embodiment of the present invention.
Figure 13:
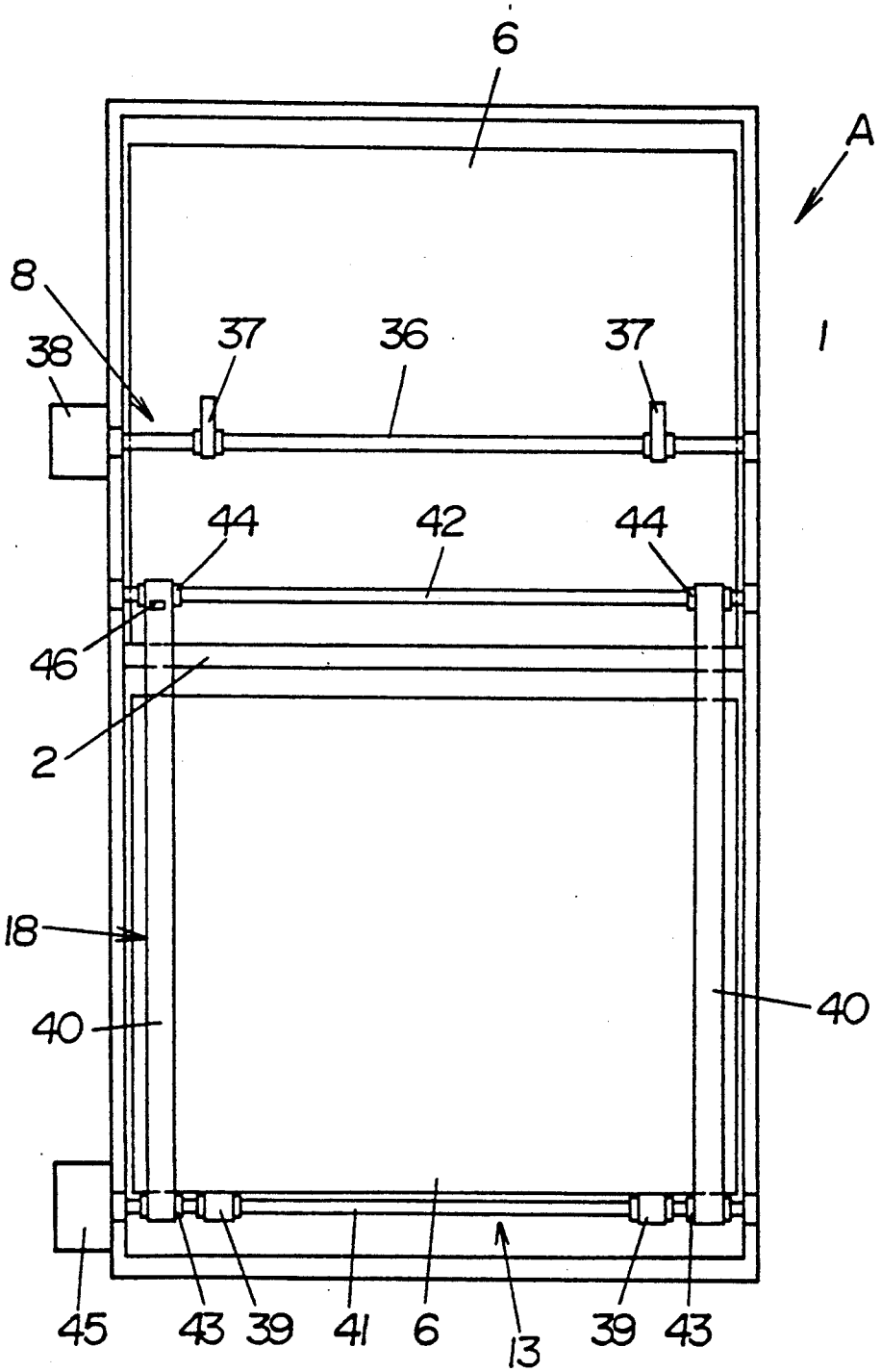
FIG. 13 is a rear view of the apparatus shown in FIG. 11, showing a state in which a rear plate of the apparatus is removed.

FIGS. 11 to 13 show a display apparatus A in accordance with a second embodiment of the present invention and in which circulating members 6 are circulated between upper and lower positions. The basic construction and function of the apparatus and circulating members 6 used are the same as those of the first embodiment.

In this embodiment, frame 1 is formed into a box-like shape having a longitudinal axis extending in a vertical direction, and has an internal space partitioned at its center into a first accommodation chamber 3 and a second accommodation chamber 4. A display window generally equal in size and shape to each of circulating members described later is formed in one side wall of the first accommodation chamber 3.

Referring to FIG. 12, a first feed means 8 serves to intermittently feed the group of circulating members 6 in the first accommodation chamber 3 toward the display window 5. An operating shaft 36 supported at its opposite ends on the frame 1 is rotatably disposed so as to extend laterally along the foremost one of these circulating members 6 on the non-display side. One or a plurality of cams 37 are axially supported on the operating shaft 36. The cams 37 are rotated in one direction by driving a motor 38 having a speed reduction mechanism and connected to one end of the shaft 36. When eccentric portions of the cams 37 are brought into contact with non-display portions of the adjacent circulating member 6, this circulating member 6 and, hence, the whole of the group of circulating members 6 is moved toward the display window 5 to the extent corresponding to the amount of eccentricity of the cam 37, i.e., corresponding to one circulating member 6. With this movement, the foremost one of the circulating members 6 is released from the front end of the partition plate 2 and is transported from this front end to the second accommodation chamber 4 by the operation of a second transport means 26 described later or falls naturally.

Figure 14:
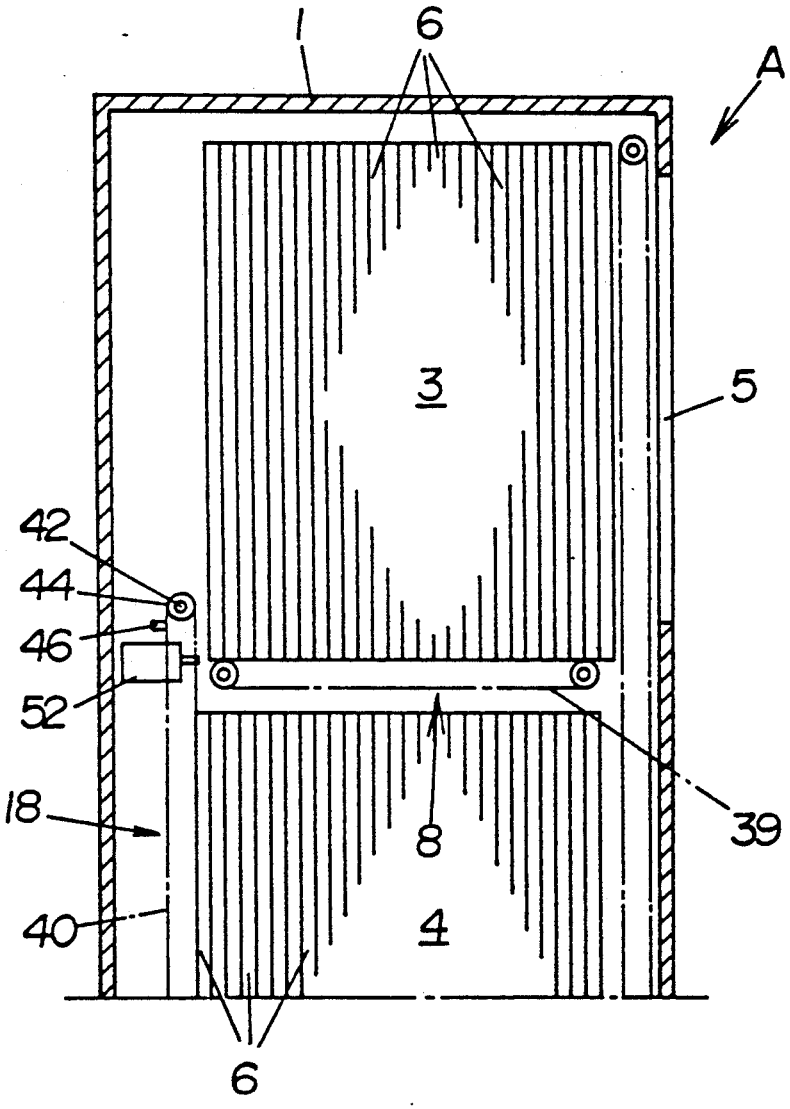
FIG. 14 is a longitudinal partial sectional side view of another example of the partition plate of the apparatus shown in FIG. 11.

The first feed means 8 may also serve as the partition plate 2 as shown in FIG. 14. In this case, the arrangement may be such that a conveyor 39 constituted by an endless belt is stretched at the center of the frame 1 so as to extend between the foremost one and the rearmost one of the circulating members 6, the group of circulating members 6 is moved toward the display window 5 by driving the conveyor 39, and a coil or plate spring set at a predetermined pressure is engaged with the surface of the rearmost one of the circulating members 6 in the direction of movement thereof to constantly intensify the force of moving the circulating members 6 toward the display window 5.

Referring again to FIG. 12, a second feed means 13 serves to feed the group of circulating members 6 in the second accommodation chamber 4 in the direction opposite to the direction of feeding of the group of circulating members 6 in the first accommodation chamber 3. A conveyor 39 constituted by an endless belt and having a length such that the group of circulating members 6 accommodated in the second accommodation chamber 4 can be placed thereon is stretched at the bottom of the frame 1. This conveyor is driven by a motor associated with a first transport means 18 described later to move in a linked relationship with this transport means. As this conveyor 39 is driven, the circulating member 6 falling from the first accommodation chamber 3 is received and placed thereon and the whole of the group of circulating members 6 is moved to the first transport means 18.

The arrangement of the second feed means 13 may also be such that a coil or plate spring (not shown) set at a predetermined pressure is engaged with the surface of the rearmost one of the circulating members 6 in the direction of movement thereof to constantly intensify the force of moving the circulating members 6 to the first transport means 18.

Referring to FIGS. 12 and 13, the first transport means 18 serves to lift the circulating members 6 into the first accommodation chamber 3. The first transport means 18 includes a belt conveyor engagable with the foremost one of the circulating members 6 on the non-display side in the second accommodation chamber 4. A pair of left and right endless belts 40 extending parallel to the surfaces of the circulating members 6 and contacting non-display portions of the foremost circulating member 6 are stretched around pulleys 43 and 44 attached to driving and driven shafts 41 and 42. A motor 45 having a speed reduction mechanism is connected to the driving shaft 41 to rotate the belts in one direction, i.e., a lifting direction.

An engagement piece 46 is provided in on or two places on each of the endless belts 40. With the movement of the endless belts 40, the engagement pieces 46 are brought into engagement with the lower side of the foremost circulating member 6 to lift the same into the first accommodation chamber 3.

A second transport means 26 shown in FIG. 12 serves to move the circulating members 6 to the second accommodation chamber 4. The second transport means 26 includes a belt conveyor engagable with the foremost one of the circulating members 6 in the first accommodation chamber 3 on the display 7a side. A pair of left and right endless belts 47 extending parallel to the surfaces of the circulating members 6 and contacting the foremost circulating member 6 are stretched around pulleys 50 and 51 attached to rotating shafts 48 and 49. The endless belts 47 are rotated in one direction, i.e., in the direction of falling of the circulating member 6 through the second feed means 13 to supply the circulating member 6 onto the second feed means 13 located at the bottom. In this case, if the circulating member 6 falls naturally, it is not specifically necessary to provided this mechanism, and natural falling may be utilized as a transport means.

The transport speed of the endless belts 47 may be set to a speed lower than the falling speed of the circulating member 6 to reduce the speed of the same as desired during falling and to prevent occurrence of noise and damage of the circulating member 6 at the time of landing.

Detection means 52 and 53 such as limit switches serve to control the rotation of the motors 38 and 45. The detection means 52 is provided in the vicinity of the upper end of the first transport means 18. The detection means 52 supplies power to the motor 38 for driving the first feed means 8 to operate the same when the engagement pieces 46 are moved upward and brought into engagement with a detection probe of the detection means 52 with the movement of the belts 40, thereby forcing the lifted circulating member 6 into the first accommodation chamber 3.

The detection means 53 is provided in the vicinity of one of the cams 37 of the first feed means 8. When the eccentric portion of the cam 37 is brought into engagement with a detection probe of the detection means 53 by the rotation of the cam 37, the detection means 53 stops supplying power to the motor 38 driving the first feed means, thereby terminating the operation of the first feed means 8.

The above-described circulating operation is controlled by using the detection means 52 and 53 to effect replacement of display portions 7a of the circulating members 6 continuously and automatically. This operation may be associated with a timer (not shown) to delay display and transportation by a predetermined time, or with a device having a clocking function to effect replacement at a time selected as desired. It may also be associated with a manual switch so that a desired one of the circulating members 6 can be displayed at a desired time by the manual operation of the user.

In this embodiment, the circulating member 6 is moved downward from the display window 5 to renew the circulating member 6 with respect to the display portion 7a. Alternatively, the circulating operation may be such that the rotations of the above means 8, 26, 13, and 18 are reversed so that each circulating member 6 is moved upward to set the display portion 7a at the display window 5.

Figure 15:
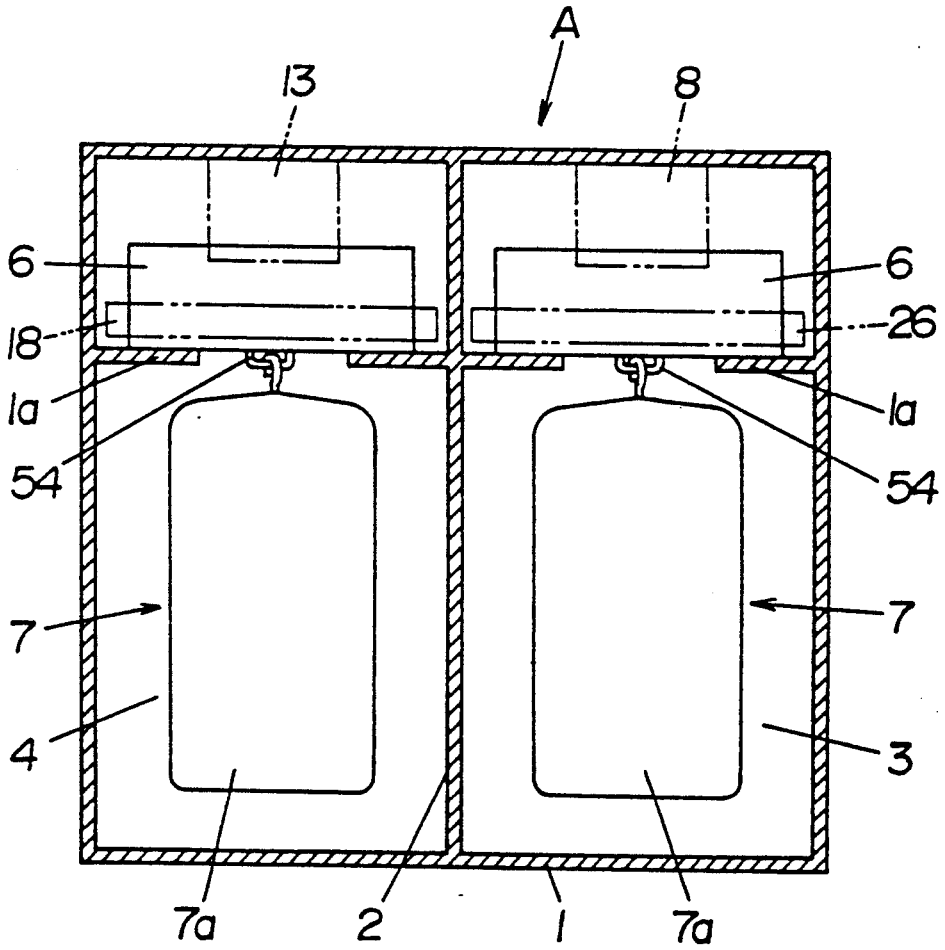
FIG. 15 is a longitudinal sectional front view of a display apparatus in accordance with a third embodiment of the present invention.

FIG. 15 shows a display apparatus in accordance with a third embodiment of the present invention, in which circulating members 6 are circulated between left and right positions, and in which display members 7 having display portions 7a are hung from the circulating members 6. The basic construction and function of the apparatus and the circulating members 6 used are the same as those of the first embodiment, and the detailed description for them will not be repeated.

Lower side surfaces of the circulating members 6 are slidably supported on a support plate 1a of the frame 1, and each display member 7 is detachably attached by engagement with engagement members 54.

Objects to be displayed on the display portions 7a or display contents include objects displayed in clothing, ornament and picture stores and exhibits of art galleries and museums, as well as calendars, notifications or advertisements, such as real property advertisements or guides, photographs, characters as mentioned above.

As described above, the display apparatus and the display method of the present invention have effects described below.

The display apparatus A and the display method using the same in accordance with the present invention include the type wherein circulating members 6 are laterally moved to successively change the display portions 7a and the type wherein circulating members 6 are moved vertically to change the display portions 7a.

However, the difference therebetween only resides in whether the direction of circulating movement is lateral or vertical, and the circulating operations thereof are the same. The effects of the invention will therefore be described below with respect to the apparatus A in which circulating members 6 are laterally moved in the frame 1.

A multiplicity of circulating members 6 with display members 7 having display portions *7a* are vertically stacked in first and second accommodation chambers 3 and 4 formed in the frame 1 so as to generally fully occupy the spaces therein in the direction of the depth thereof and so that the display portions *7a* face in the same direction.

First and second feed means 8 and 13 and first and second transport means 18 and 26 are driven. The first and second feed means 8 and 13 thereby move one group of circulating members 6 in the first accommodation chamber 3 toward the display window 5 and the other group in the second accommodation chamber 4 toward the non-display end opposite to the display window 5.

The foremost ones of the groups of circulating members 6 are thereby brought into engagement with the first and second transport means 18 and 26. Then, the foremost one of the circulating members 6 in the first accommodation chambers 3 is transported or shifted in position into the second accommodation chamber 4 and the foremost one of the circulating members 6 in the second accommodation chambers 4 into the first accommodation chamber 3.

The foremost one of the circulating members 6 in the first accommodation chambers 3 is thereby replaced with the next circulating member 6 to display the display portion *7a* of this circulating member through the display window 5 provided on the first accommodation chamber 3.

This operation is repeated continuously or intermittently, so that the multiplicity of circulating members 6 accommodated in the first and second chambers 3 and 4 are moved one by one to the chambers 3 and 4, thus renewing the display portion *7a* of the circulating member 6 at the display window 5.

What is claimed is:

1. A display apparatus comprising:

a frame having an internal space;

first and second accommodation chambers formed in the internal space and defined by means of a partition plate;

a plurality of circulating members having display members with display portions facing in one direction, said circulating members being divided into two groups and stacked in the first and second accommodation chambers, a display window formed in one side wall of the first accommodation chamber and having a size substantially equal to that of the circulating member, first feed means situated in the first accommodation chamber and having a motor with a shaft, means comprising a cam attached to the shaft and a press-feed member contacting the cam for advancing the stack of circulating members in the first accommodation chamber toward the display window, second feed means situated in the second accommodation chamber and having a motor with a shaft, means comprising a cam attached to the shaft and a press-feed member contacting the cam for advancing the stack of circulating members in the second accommodation chamber in a direction away from the display window, first transport means for transporting one of the circulating members in the second accommodation chamber located away from the second feed means to the first accommodation chamber adjacent the first feed means, said first transport means having an endless belt extending parallel to a surface of the circulating member, an engagement piece attached to the endless belt for engaging with the circulating member, and a motor for rotating the endless belt, second transport means for transporting one of the circulating members in the first accommodation chamber located adjacent the display window to the second accommodation chamber adjacent the second feed means, said second transport means having an endless belt extending parallel to a surface of the circulating member, an engagement piece attached to the endless belt for engaging with the circulating member, and a motor for rotating the endless belt, first detection means situated near the first feed means, said first detection means detecting one movement of the circulating member in the first accommodation chamber by the first feed means and actuating the first and second transport means, and second detection means situated near the first transport means, said second detection means detecting one movement of the circulating member in the second accommodation chamber by the first transport means and actuating the first and second feed means.

2. An apparatus according to claim 1, wherein the display portion of said display member is provided on at least one of two surfaces of said display member.

3. An apparatus according to claim 1, wherein said display window is formed in one side wall of at least one of said first and second accommodation chambers.

4. An apparatus according to claim 1, wherein said display window is formed in each of two side walls of at least one of said first and second accommodation chambers.

5. A display apparatus according to claim 1, wherein said first and second accommodation chambers are laterally arranged in the internal space of the frame.

6. A display apparatus according to claim 5, wherein same number of the circulating members are disposed in the first and second accommodation chambers, and said engagement pieces of the first and second transport means engage lower portions of the circulating members.

* * * * *